US009885533B2

(12) United States Patent
Griffitts

(10) Patent No.: US 9,885,533 B2
(45) Date of Patent: Feb. 6, 2018

(54) BARREL STABALIZING AND RECOIL REDUCING MUZZLE BRAKE

(71) Applicant: James Norman Griffitts, Maryville, TN (US)

(72) Inventor: James Norman Griffitts, Maryville, TN (US)

( * ) Notice: Subject to any disclaimer, the term of this patent is extended or adjusted under 35 U.S.C. 154(b) by 0 days.

(21) Appl. No.: 15/066,988

(22) Filed: Mar. 10, 2016

(65) Prior Publication Data

US 2017/0261282 A1 Sep. 14, 2017

(51) Int. Cl.
*F41A 21/36* (2006.01)
*F41C 27/22* (2006.01)

(52) U.S. Cl.
CPC ..... *F41A 21/36* (2013.01); *F41C 27/22* (2013.01)

(58) Field of Classification Search
CPC ..... F41A 21/34; F41A 21/325; F41A 21/32; F41A 21/30; F41A 21/36; F41A 21/38; F41A 21/28; F41A 21/00
USPC ..... 42/1.06; 89/14.4, 14.3
See application file for complete search history.

(56) References Cited

U.S. PATENT DOCUMENTS 618,901 A 2/1889 Peterson
785,974 A * 3/1905 McClean ..... F41A 5/26 89/14.3
1,174,165 A * 3/1916 Kenney ..... F41A 21/36 89/14.3
1,333,402 A * 3/1920 Galliot ..... F41A 21/36 89/14.3
1,363,058 A * 12/1920 Schneider ..... F41A 21/36 89/14.3
1,429,619 A * 9/1922 Nelson ..... F41A 21/36 89/14.3
1,502,558 A * 7/1924 Galliot ..... F41A 21/36 89/14.3
1,605,393 A * 11/1926 Cutts, Jr. ..... F41A 21/36 89/14.3
1,901,138 A * 3/1933 Barnes ..... F41A 21/36 89/14.3
1,948,496 A * 2/1934 Barnes ..... F41A 21/36 89/14.3
2,143,596 A * 1/1939 Galliot ..... F41A 21/36 89/14.3
2,212,684 A 8/1940 Hughes
2,223,014 A * 11/1940 Galliot ..... F41A 21/36 89/14.3
2,403,007 A * 7/1946 Maris ..... F41A 21/36 89/14.3
2,453,121 A * 11/1948 Cutts ..... F41A 21/36 42/79
2,742,821 A 4/1956 Sweetman
(Continued)

*Primary Examiner* — Derrick R Morgan
(74) *Attorney, Agent, or Firm* — Pitts & Lake, P.C.

(57) ABSTRACT

A muzzle brake for high power rifles, hand guns, machine guns, and artillery, exhibiting barrel stabilization and recoil reduction, by capturing gasses against a caliber specific orifice end plate and redirecting these gases both out of the muzzle brake, and into the muzzle brake to fill the partial vacuum left by the exiting high pressure gases, by way of Major truncated socket forms, and to a lesser extent, with the use of Minor truncated socket forms, and their associated vent ports in an asymmetrical pattern that balances barrel lift, and recoil against the expected and recovered gases.

13 Claims, 9 Drawing Sheets

(56) References Cited

U.S. PATENT DOCUMENTS 2,842,024 A * 7/1958 Mutter ..... F41A 21/28 42/76.01
2,899,866 A * 8/1959 Clark et al. ..... F41A 21/32 89/127
3,141,376 A * 7/1964 Chinn ..... F41A 21/36 89/14.3
3,492,912 A * 2/1970 Ashbrook ..... F41A 21/36 181/223
D285,238 S * 8/1986 Cellini ..... 89/14.3
4,691,614 A * 9/1987 Leffel ..... F41A 21/36 89/14.3
4,852,460 A * 8/1989 Davidson ..... F41A 21/36 89/14.05
4,879,942 A * 11/1989 Cave ..... F41A 21/36 89/14.3
4,930,397 A * 6/1990 Seidler ..... F41A 21/36 89/14.3
4,945,812 A * 8/1990 Mazzanti ..... F41A 21/36 89/14.3
5,036,747 A * 8/1991 McClain, III ..... F41A 21/36 89/14.3
D343,222 S * 1/1994 Morales ..... 89/14.3
5,320,022 A * 6/1994 Kimbro ..... F41A 21/36 89/14.3
5,333,529 A * 8/1994 Brockman ..... F41A 21/38 42/79
5,357,842 A * 10/1994 Reynolds ..... F41A 21/36 89/14.3
5,423,242 A * 6/1995 Schuemann ..... F41A 21/28 89/14.3
5,425,298 A * 6/1995 Coburn ..... F41A 21/38 89/14.3
6,516,698 B1 * 2/2003 Poff, Jr. ..... F41A 21/46 89/14.6
7,032,339 B1 4/2006 Bounds
7,600,461 B1 * 10/2009 Cler ..... F41A 21/36 89/14.3
7,954,414 B2 6/2011 Dueck
8,250,962 B1 * 8/2012 Guenther ..... F41A 21/28 42/107
8,627,755 B1 1/2014 Eckel
8,695,475 B2 * 4/2014 Schneider ..... F41A 13/12 42/1.06
9,163,891 B1 * 10/2015 Dater ..... F41A 21/34
9,207,034 B2 * 12/2015 Larson, Jr. ..... F41A 3/66
2004/0244571 A1 * 12/2004 Bender ..... F41A 21/38 89/14.3
2011/0226121 A1 * 9/2011 Peterson ..... F41A 21/36 89/14.3
2012/0246987 A1 * 10/2012 Anthony ..... F41A 21/30 42/1.06
2013/0227871 A1 * 9/2013 Stone ..... F41A 21/30 42/76.1
2013/0233162 A1 * 9/2013 Schneider ..... F41A 13/12 89/14.3
2014/0165438 A1 * 6/2014 Wilkinson ..... F41A 21/36 42/1.06
2015/0308778 A1 * 10/2015 Vossler ..... F41A 21/36 89/14.3
2016/0209153 A1 * 7/2016 Dueck ..... F41A 21/32

* cited by examiner

BARREL STABALIZING AND RECOIL REDUCING MUZZLE BRAKE

FIELD OF THE INVENTION

The invention is a muzzle brake, a device designed to control firearm recoil, barrel lift, and lateral deflection as found in hand guns, high power rifle, and other firearms during and after discharge of a projectile, by capturing and then using the high pressure gas being pushed in front of a projectile, and then using the hot high pressure gas pushing a projectile, and then the atmospheric pressure gas that rushes back into the firearm barrel to fill the partial vacuum left in the firearm barrel due to the inertia of the hot high pressure gas leaving the barrel of the firearm.

BACKGROUND OF THE INVENTION

Historically, firearms utilizing a barrel design date back many centuries, by controlling and focusing the energy of the gases produced by rapidly burning (propellant) gun powder, these firearms are capable of propelling projectiles a great distance at a high velocity in the required direction. Control of recoil and barrel movement resulting from high pressure expanding gas reacting against a projectile, acceleration of that projectile, and acceleration of the column of atmospheric gas in front of that projectile in modern firearms is the purposeful need for this invention. The invention augments a firearm in the scope of a precision muzzle brake exhibiting refinement of control of the kinetic energy of the atmospheric gas as it is being expelled in front of the projectile and the kinetic energy of the gas produced by the burning propellant behind the projectile to both reduce the recoil of the firearm and stabilize it.

Internal Ballistics of Guns is the science of turning the potential energy of a propellant (gun powder) into kinetic energy by burning, thus releasing hot high pressure gas propelling a projectile from a gun barrel. Research in this field of science, and now approved for public release by The United States Army Material Command, teaches authoritative reference information and data to aid scientists and engineers to design new weapons and accessories and components for application to rifled, smooth bore and recoilless guns.

Physics reveals Newton's Third Law of Mechanics, known as, the law of Action and Reaction. When a body is given a certain momentum in a given direction, some other body or bodies will get an equal momentum in the opposite direction. Newton's third law teaches that the substantial forces unleashed in a modern firearm barrel, exhibit action and reaction as studied in the science of Internal Ballistics. Action and Reaction are the forces of Internal Ballistics that are exploited and controlled by the present invention. Firing a projectile from the barrel of a firearm exerts a shock force over a very short time duration, and is experienced as recoil, also known as kick back. The recoil or rapid acceleration of the firearm imparted toward the breech end of a firearm by firing a projectile imparts energy to the individual, or mechanism holding the firearm and can be mild to devastating to the individual or mechanism holding the firearm, depending on the amount of energy involved, the mass and velocity of the propellant, the mass and velocity of the atmospheric air in front of the projectile, the mass and velocity of the projectile, and the mass of the firearm.

Over time the shock force generated can have a detrimental effect on the firearm and the optics or other sighting system used on the firearm. Also over time the shock force generated impacts the mechanism and mounting points holding the weapon when utilized in aircraft, mobile vehicles, and field mounted equipment. The same can also be applied to navel equipment. Recoil also contributes directly to the reduced control of the firearm, and over time results in damage to the mounting arrangement leading to eventual failure. Movement of the firearm due to uncontrolled or poorly controlled recoil requires repositioning of the firearm and reacquisition of the target before another projectile can be fired.

Reduced recoil and reduced firearm movement allows much faster target reacquisition and precise control for quicker future shots. Reduced recoil and reduced firearm movement also allows greatly enhanced control of hand held and mounted full auto fire. Reduced wear and tear on the firearm and mounting system will provide an extended service life for the system.

The muzzle brake is typically attached to the muzzle end of a firearm by threading the exterior of the firearm barrel muzzle and threading the interior of the muzzle brake. This mounting method has long been established as a preferred method of attaching the muzzle brake to the muzzle end of a firearm barrel.

Those skilled in the art will recognize that the thread size is dependant on the caliber of the firearm and the diameter of the barrel whereas a larger caliber firearm will require a larger thread size on the muzzle end of the barrel, and a larger internal thread in the end of the attachment muzzle brake body. A muzzle brake of this design may be removed and reattached at will. Alternate methods of attachment such as Silver Solder, Press Fitting, and clamping to the external diameter of the muzzle end of the firearm are also contemplated.

Prior art discloses muzzle brake designs featuring gas venting ports. Prior art also discloses a multitude of muzzle brake designs featuring venting ports angled toward the shooter, and of radial skew placements of venting ports relative to the bore centerline.

Muzzle brake designs that incorporate vent ports that are perpendicular to the bore centerline are features well known to engineers and builders of devices in an attempt to counter the recoil generated by firing a projectile from a firearm barrel.

The United States Patent and Trademark Office has granted to inventors of muzzle brake designs, a multitude of patents featuring varying chambers and vents for exhausting the rapidly expanding hot gases directly following the expulsion of the projectile from the muzzle of the gun barrel.

A list of prior art Patents is cited by reference patent numbers for comparison of features of prior art inventions by the many inventors that have contributed to the vast store of knowledge present in The United States Patent And Trademark Office, homage is paid to the many inventors who have made an effort to contribute to the wealth of technology maintained therein.

SUMMARY OF THE INVENTION

This firearm muzzle brake is of an advanced precision design that substantially reduces the recoil of a firearm, vertical deflection of the barrel, and the lateral movements of the firearm.

The present invention is an advanced firearm muzzle brake utilizing various modern alloy metals such as, chrome-molybdenum steel, precipitation hardening 17-4 stainless steel, 416 stainless steel, and other materials as appropriate in the manufacture of modern firearms. The current muzzle brake invention, created as a device to be attached to the muzzle end of firearm, can also be created as an integral part of the firearm barrel. This muzzle brake can be created in a variety of external and internal configurations, such as cylindrical, oval, square, and rectangular, but is not limited to these forms.

The present firearm muzzle brake features a gas capture chamber disclosing a chamber superior in size to the firearm barrel bore, with a caliber specific orifice end plate distal of the of the firearm barrel muzzle. The orifice end plate and the gas capture chamber are precision machined with a plurality of openings designed to capture then utilize the column of gas preceding the projectile and exiting the muzzle of the bore of the firearm.

The plurality of openings into the gas capture chamber is preferably, at an angle towards the breech of the firearm. The many openings into the gas capture chamber form geometry conducive to the exploitation of the captured high pressure gas whereby creating forward thrust on the muzzle brake and firearm, thus reducing recoil. The number, geometric forms, and distribution of these openings also control muzzle rise when firing.

The plurality of openings into the gas capture chamber partially penetrate into the gas capture chamber through the inner wall, where all of the openings are disclosing a truncated socket form that presents a small area to capture part of the column of high pressure gas preceding the projectile exiting the muzzle of the bore of the firearm. The preferred form of the openings is cylindrical in shape with a spherical truncated socket form that does not penetrate to the full diameter of the cylindrical opening thereby leaving a truncated spherical nozzle at the interface between the opening and the interior wall of the gas capture chamber, and as thus formed, captures and utilizes portions of the rapidly moving column of high pressure gas preceding the projectile in the First Event of the Internal Ballistics processes.

The First process is where the majority of the column of high pressure gas preceding the projectile is captured by the gas capture chamber and utilized by the muzzle brake to reduce the recoil and muzzle rise of the firearm.

This column of high pressure gas preceding the projectile is thus acting as a fluid and the muzzle brake utilizes the kinetic energy of this fluid to counter the recoil by acting against the caliber specific orifice end plate until the projectile exits the muzzle brake.

The restriction at the orifice, in the muzzle brake end plate, causes a substantial portion of the high pressure gas to be diverted into the Major truncated socket forms and out and rearward by the forward most openings and in the muzzle brake whereupon, imparting energy in a forward direction to the muzzle brake and to the firearm reducing recoil and muzzle rise.

The Second process is the restriction of the high pressure gases at the orifice end plate whereby this forces a portion of the column of gas acting as a fluid to be expelled through the Minor truncated socket forms that are the next set of openings towards the breech. The third stage of the process is a diminished portion of the column of high pressure gas acting as a fluid is expelled through the next set of Minor truncated socket forms that are the next set of opening towards the breech. The process continues as each portion of high pressure gas is expelled from the muzzle brake. This process of stages reduces the recoil at the beginning, and through out all the stages to reduce the recoil and muzzle rise.

The Main Event of Internal Ballistics now follows. The projectile exiting the bore of the firearm is followed by a column of hot high pressure gas acting as a fluid, and is now captured by the gas capture chamber and is utilized by the caliber specific orifice end plate to reduce recoil and muzzle rise as the projectile exits the muzzle brake of the firearm. Part of this captured hot high pressure gas is expelled out through, and rearward by the Major truncated socket forms and associated openings, imparting more forward thrust on the firearm.

The second part of this event process is the resistance of the caliber specific orifice end plate, causing pressure to build in the muzzle brake and forces a portion of the column of hot high pressure gas acting as a fluid to be expelled by the next set of truncated socket forms and openings toward the breach of the firearm reducing recoil and muzzle rise.

The third part of this event process is a diminished portion of the column of hot high pressure gas acting as a fluid to be expelled at the next set of truncated socket forms and openings. The process continues as each portion of hot high pressure gas is expelled from the muzzle brake. This process of events propels the firearm forward further reduces the recoil. All these forces are utilized to reduce the recoil, and muzzle rise in the present high precision muzzle brake invention.

The present muzzle brake has an unusual and inventive way of capturing the column of high pressure gas heretofore not utilized, first as high pressure gas preceding the projectile, then as hot high pressure gas, following the projectile, and then acting by redirecting both to create thrust within the muzzle brake forcing it forward against the recoil and down against the associated muzzle rise, thus two separate events are utilized, to propel the firearm forward reducing recoil and muzzle rise. These two events are followed by a third event:

In the third event, as the last of the hot high pressure gas exit's the caliber specific muzzle end plate orifice, and through the truncated socket forms, the last event begins.

All of the hot high pressure gas has exited the muzzle brake at supersonic speed, due to inertia, a "Partial Vacuum" now exists in the firearm barrel and muzzle brake, and next Atmospheric gas now begins to rush back into the muzzle brake and firearm barrel at supersonic speed through the truncated socket forms and the caliber specific end plate orifice.

The muzzle brake end plate with a caliber specific orifice, acts as a restriction point for the Atmospheric gas to fill the "partial vacuum" in the muzzle brake and firearm barrel.

The plurality of truncated socket forms through the muzzle brake body penetrating into the gas capture chamber allow a very fast intake of Atmospheric gas to fill the muzzle brake and firearm barrel, and in this moment the truncated socket forms "working in reverse gas flow" pull the muzzle brake and firearm forward further reducing the recoil.

A simple example is given wherein a change in direction of air flow through the various truncated socket forms will exert forward force on the muzzle brake and firearm regardless of the direction of the gas flow.

BRIEF DESCRIPTION OF THE DRAWINGS

The above-mentioned features of the invention will become more clearly understood from the following detailed description of the invention read together with the drawings in which:

FIG. 1, B Is an end view of the cross-section in FIG. 1, A.

FIG. 2, A Is a partial cross-section view of a firearm barrel for the muzzle brake to be attached to.

FIG. 2, B Is a cross-sectional view of a muzzle brake body, in attachable and removable form, for a firearm disclosing an internal gas capture chamber utilizing a plurality of precision radially skewed vents with truncated socket end forms, partially penetrating the gas capture chamber wall and significantly penetrating the threaded caliber specific insert orifice end plate of the muzzle brake.

FIG. 2, C Is an end view of the cross-section in FIG. 2, B.

FIG. 3, B Is a cross-section view of FIG. 3, A in the plane shown.

DETAILED DESCRIPTION OF THE INVENTION

Figure 1A:
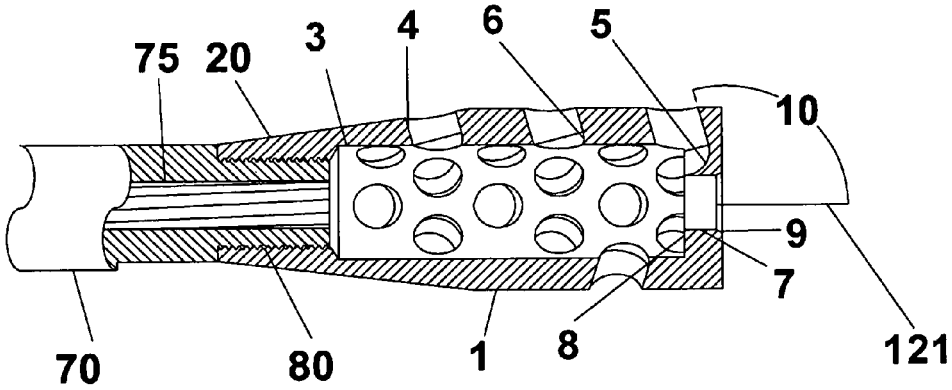
FIG. 1, A Is a cross-sectional view of a muzzle brake body, in attachable and removable form, for a firearm disclosing an internal gas capture chamber utilizing a plurality of precision radially skewed vents with truncated socket end forms, partially penetrating the gas capture chamber wall and significantly penetrating the caliber specific muzzle brake exit orifice end plate.
Figure 1B:
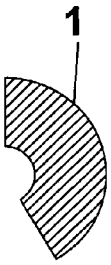

Citing the teaching of FIG. 1, A drawing is a form of muzzle brake 1 utilizing an end plate being an integral part of the body of the muzzle brake.

Figure 2A:
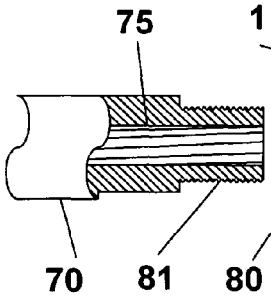
Figure 2B:
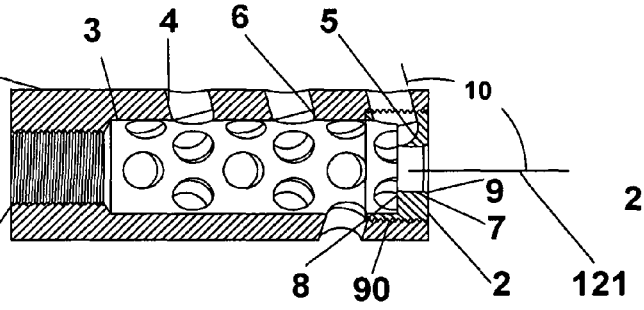
Figure 2C:
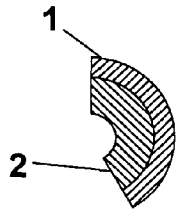

Citing the teaching of the preferred embodiment of the FIG. 2, B drawing disclosing a cross-sectional view for a muzzle brake 1 being externally and internally cylindrical in shape and revealing a gas capture chamber 3 superior in size to the bore 75, that features a threaded 90 gas capture chamber insert end plate 2 exhibiting a plurality of radially skewed (11, FIG. 3, B) precision angle 10 vent ports 4, introduced at a 105 degree angle 10 relative to the center line 121 of the bore of the firearm and the direction of the path (131, FIG. 9,A) of the projectile 100, reveals and define distinctly, and for clarity, Major truncated socket forms 5 at and in conjunction with said 105 degree angle 10 vent ports introduced substantially into said gas capture chamber 3 end plate 2 face wall 8 of the threaded 90 said gas capture chamber 3 insert end plate 2.

A muzzle brake 1 being externally and internally cylindrical in shape and revealing a gas capture chamber 3 that features and exhibits a plurality of radially skewed (11, FIG. 3, B), precision angle 10 introduced vent ports 4, at said 105 degree angle 10 relative to the center line 121 of the bore of the firearm and the direction of said path (131, FIG. 9, A) of said projectile 100, reveals and define distinctly, and for clarity, Minor truncated socket forms 6 at and in conjunction with said 105 degree angle 10 vent ports 4. The muzzle brake 1 is internally threaded 80 for attachment to any appropriately externally threaded 81 muzzle end of a firearm barrel 70 of compatible size and caliber and is thus an attachment and accessory that can be attached or removed from the firearm. The gas capture chamber 3 within said muzzle brake 1 captures the high pressure gas acting as a column of fluid that is forced into the said gas capture chamber 3. This is the First Event acted on by said muzzle brake 1 in the chain of events relating to the Internal Ballistics of a firearm.

The preferred embodiment of said muzzle brake 1 invention discloses the said gas capture chamber 3 that features a threaded 90 gas capture chamber, insert end plate 2 exhibiting a plurality of radially skewed (11, FIG. 3, B), precision angle 10 vent ports 4. Said vent ports 4 are by design introduced at a said 105 degree angle 10 relative to the center line 121 said bore 75 of the firearm and in the direction of the path (131, FIG. 9, A) said projectile 100. Said vent ports 4 at said 105 degree angle 10 reveal and define said Major truncated socket forms 5 at and in conjunction with said 105 degree angle 10 vent ports 4 substantially introduced into the said gas capture chamber 3 end plate 2, internal face wall 8 of the threaded 90 said gas capture chamber 3 insert end plate 2. Alternate design of said vent ports 4 at said 105 degree angle 10 are to be contemplated in this comprehensive Physics teaching of muzzle brake Dynamics as to, The Study of Motion: The branch of mechanics that deals with motion and the way in which forces produces this motion.

Said vent ports 4 at said 105 degree angle 10 can by design be introduced at any angle from an angle of 90 degrees up to an angle of 135 degrees towards the breech of the firearm relative to said center line 121 of the bore 75 of the firearm and the direction of the path (131, FIG. 9, A) of said projectile 100. The preferred embodiment of the muzzle brake 1 invention discloses the said gas capture chamber 3 that distinctly and for clarity exhibits a plurality of radially skewed (11, FIG. 3, B), precision angle 10 introduced vent ports 4 at said 105 degree angle 10 reveal and define Minor truncated socket forms 6 at and in conjunction with said 105 degree angle 10 vent ports 4.

Said Minor truncated socket forms 6 preferably fails total penetration into the said gas capture chamber 3 interior wall thereby exhibiting vent ports 4 at said 105 degree angle 10 with a nozzle shaped truncated socket form 6 at the internal diameter interface with said gas capture chamber 3. Said Minor truncated socket forms 6 can by design penetrate in depth by varying amounts into said gas capture chamber 3 at the internal diameter interface, and can be on the order of 10 percent penetration, and up to 99.9 percent penetration at the internal diameter interface of said gas capture chamber 3.

Figure 3A:
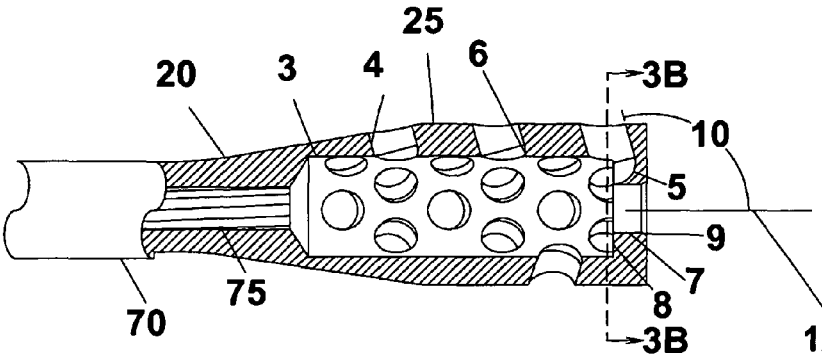
FIG. 3, A Is a cross-sectional view of a muzzle brake body, as an integral part of the firearm barrel, disclosing an internal gas capture chamber utilizing a plurality of precision radially skewed vents with truncated socket end forms, partially penetrating the gas capture chamber wall and significantly penetrating the caliber specific muzzle brake exit orifice end plate.
Figure 3B:
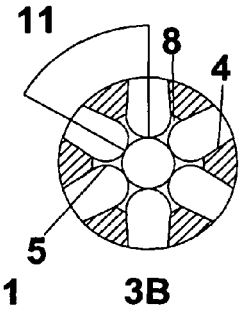

The alternate monolithic embodiment FIG. 3, A with a barrel blend form 20 of the muzzle brake 25 invention discloses the said gas capture chamber 3 that first captures the highly compressed column of Atmosphere gas in the firearm bore 75 and said gas capture chamber 3 as it proceeds the projectile 100 prior to the projectile 100 entering into the said gas capture chamber 3 of said monolithic embodiment muzzle brake 25. Whereas this is the beginning of the first event, in the chain of events that reduce recoil and muzzle rise in the firearm.

Figure 4:
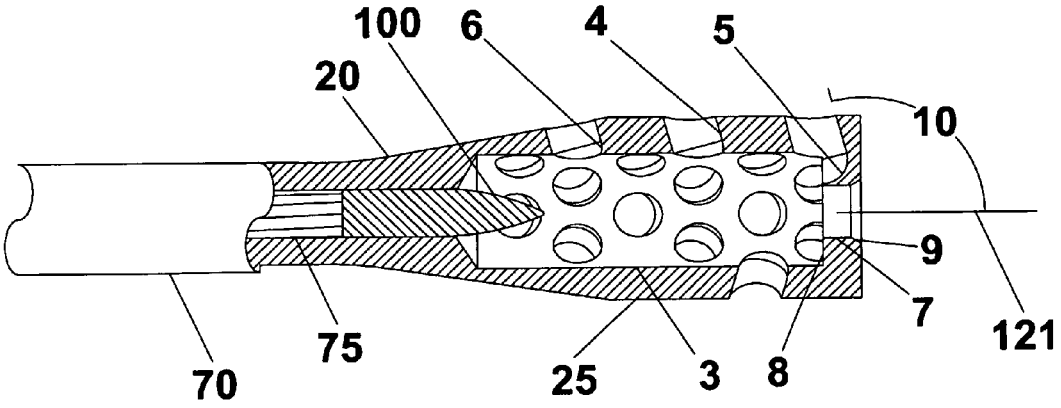
FIG. 4 Is a cross-sectional view of a muzzle brake body, as an integral part of the firearm barrel, with a projectile entering the internal gas capture chamber utilizing a plurality of internal precision radially skewed vents with truncated socket end forms, partially penetrating the gas capture chamber wall and significantly penetrating the caliber specific muzzle brake exit orifice end plate.

Citing FIG. 4, the alternate embodiment of the muzzle brake discloses a cross-sectional view of the firearm barrel with integral muzzle brake 25, featuring a monolithic embodiment and being in a cylindrical form with said gas capture chamber 3, with projectile 100 beginning to exit the firearm barrel bore 75. The firearm muzzle brake 25 accomplishes a series of events that first captures the highly compressed column of Atmospheric gas preceding the projectile 100 prior to said projectile 100 passing through the said gas capture chamber 3 of said muzzle brake 25.

Wherein the highly compressed column of Atmospheric gas preceding the projectile 100 has attained a high pressure of approximately 20,000 pounds per square inch, and has nearly equalized with the hot high pressure expanding gas in the firearm barrel bore 75, that is propelling the projectile 100 forward, and acts within the said gas capture chamber 3 by impacting the said gas capture chamber 3 end plate wall 8 and is being restricted by the orifice 7, and imparts substantial energy to the end plate wall 8. This high pressure gas is then diverted into said Major truncated socket forms 5 and out exhaust port vents 4 at said 105 degree angle 10 resulting in more energy being imparted to the muzzle brake thereby reducing recoil. The following remainder of this highly compressed column of atmospheric gas is then forced into and acts upon the said Minor truncated socket forms 6 and forced out exhaust port vents 4 at said 105 degree angle 10 imparting additional energy in the forward direction further reducing the recoil of the firearm.

Figure 5:
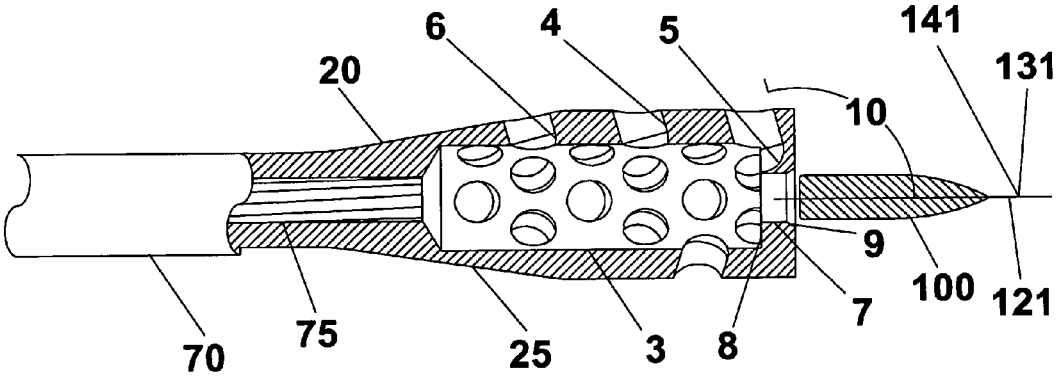
FIG. 5 Is a cross-sectional view of a muzzle brake body, as an integral part of the firearm barrel, with a projectile exiting the internal gas capture chamber utilizing a plurality of precision radially skewed vents with truncated socket end forms, partially penetrating the gas capture chamber wall and significantly penetrating the caliber specific muzzle brake exit orifice end plate.
Figure 6:
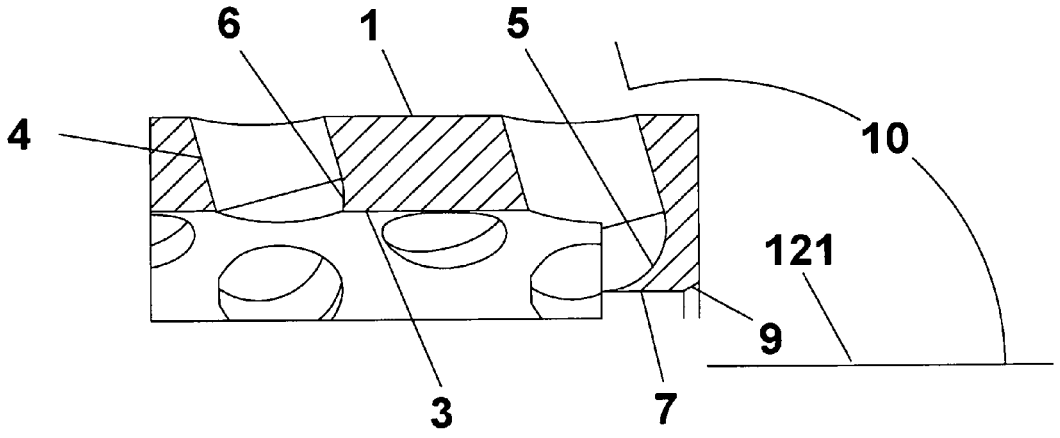
FIG. 6 Is an enlarged partial vertical cut cross-sectional view for clarity, of a muzzle brake body exhibiting the internal gas capture chamber utilizing a plurality of precision radially skewed vents with truncated socket end forms, partially penetrating the gas capture chamber wall and significantly penetrating the caliber specific muzzle brake exit orifice end plate.
Figure 7:
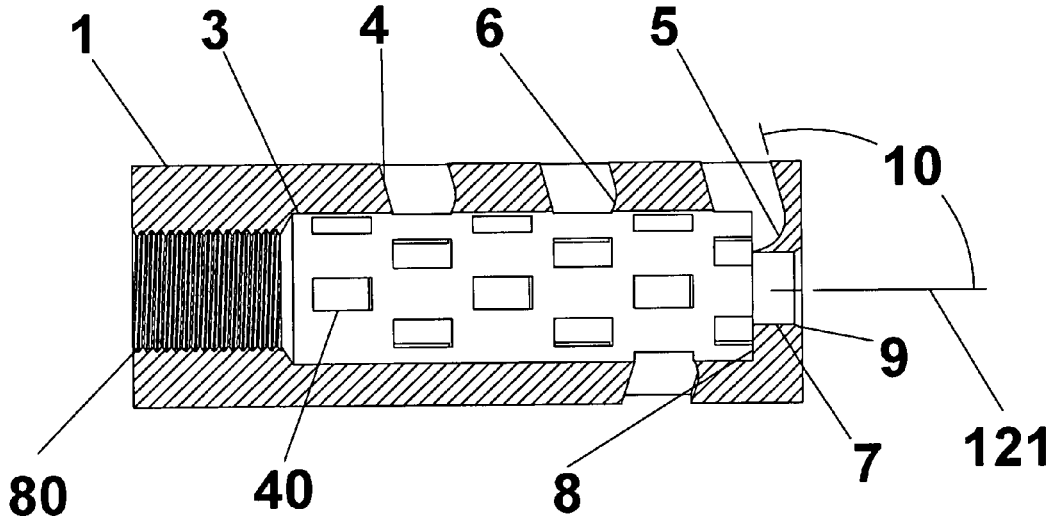
FIG. 7 Is a cross-sectional view of a muzzle brake body in attachable and removable form for a firearm disclosing an internal gas capture chamber utilizing a plurality of precision radially skewed vents with truncated socket end forms, partially penetrating the gas capture chamber wall and significantly penetrating the caliber specific muzzle brake exit orifice end plate being as an integral part of the muzzle brake depicting one of many possible alternate vent and truncated socket forms.
Figure 8A:
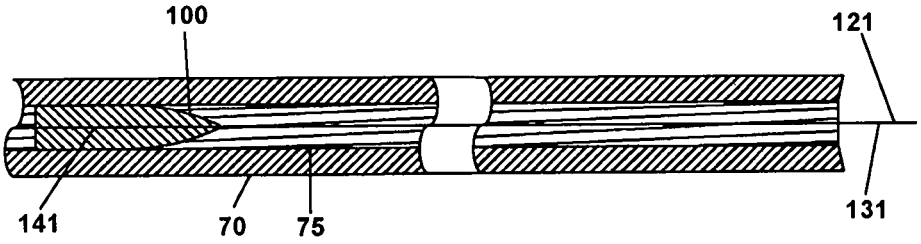
FIG. 8, A THROUGH FIG. 8, E Is a cross-sectional view of a firearm barrel without a muzzle brake, and a depiction of its reaction when discharged.
Figure 8B:
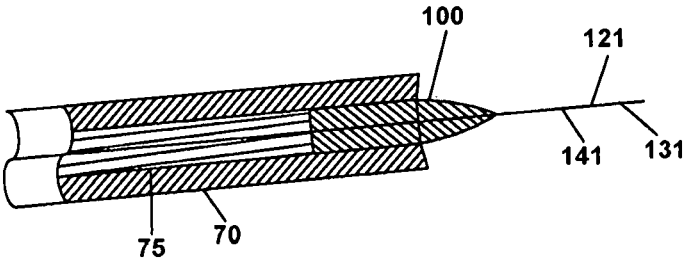
Figure 8C:
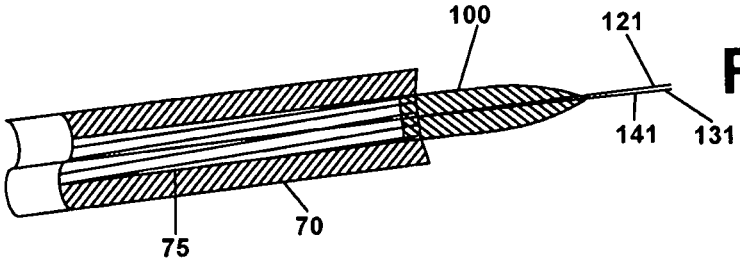
Figure 8D:
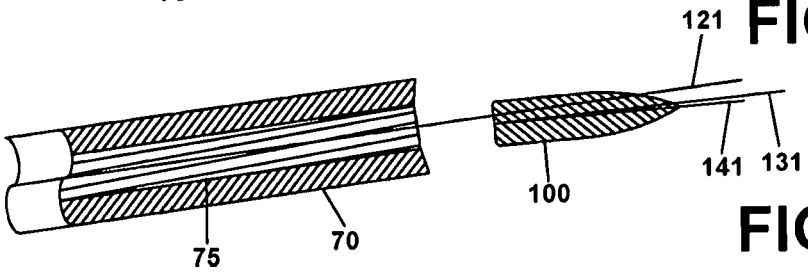
Figure 8E:
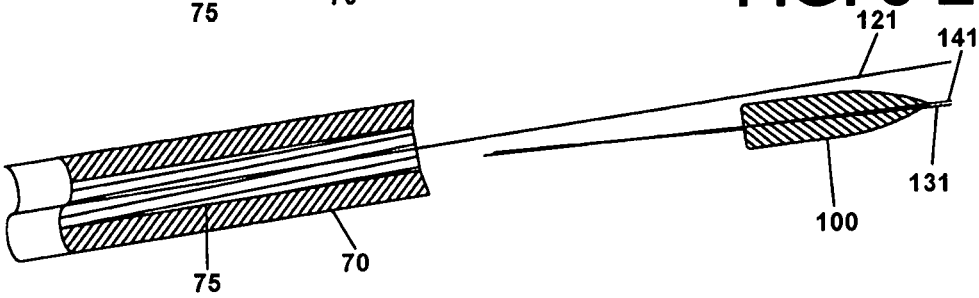
Figure 9A:
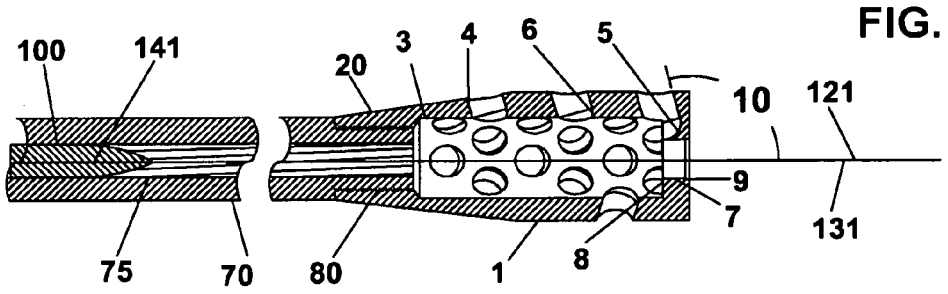
FIG. 9, A THROUGH FIG. 9, D Is a cross-sectional view of a firearm barrel with a muzzle brake, and a depiction of its lack of reaction when discharged.
Figure 9B:
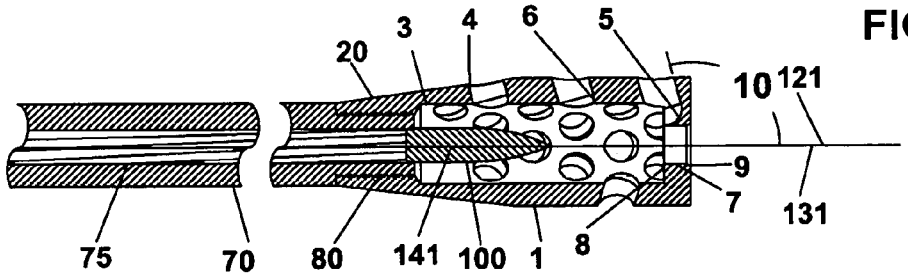
Figure 9C:
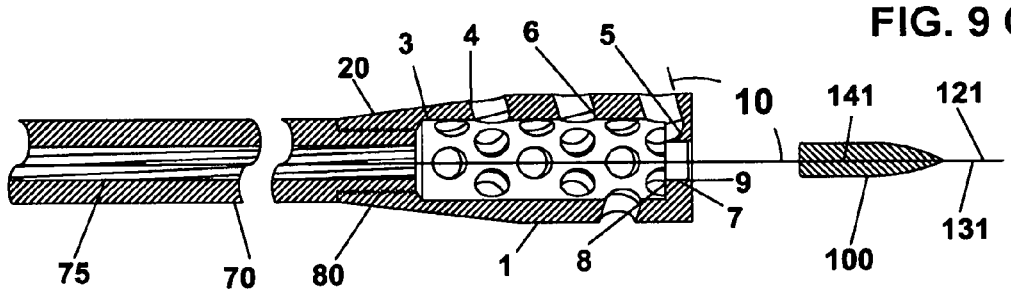
Figure 9D:
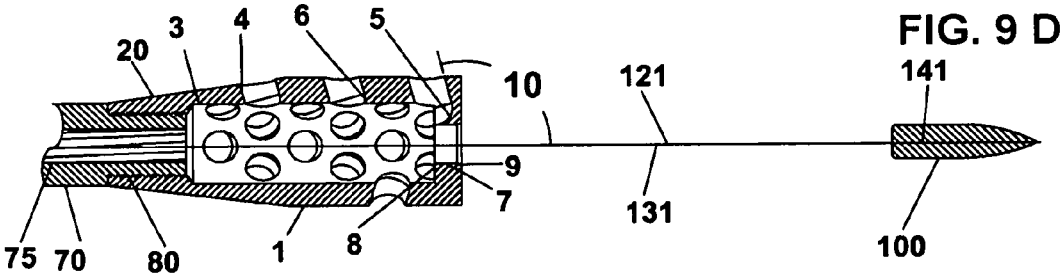

Citing FIG. 5 The Second Event now follows; within 0.0012 of a second the projectile 100 passes through the said gas capture chamber 3 as the hot high pressure expanding gas in the firearm bore 75 propels the projectile 100 forward and acts upon said gas capture chamber 3 by impacting the said gas capture chamber 3 said end plate wall 8 and being restricted by the orifice 7. The second and more substantial mass and energy of the hot high pressure gas following the projectile is forced into the Major truncated socket forms 5 and is expelled from the vent ports 4 at said 105 degree angle 10 and then the following hot high pressure gas is forced into and acts upon said Minor truncated socket forms 6 and out exhaust port vents 4 at said 105 degree angle 10 imparting force in the forward direction thus further reducing the recoil of the firearm.

The Third Event now follows; within 0.00005 of a second, the projectile 100 now exit's the muzzle brake orifice 7 end plate (2 FIG. 2, B). A short time after this event, the firearm barrel bore 75 and the muzzle brake 25 gas capture chamber 3 and exhaust ports 4 have exhausted all the hot high pressure gas and with completion of this event, due to the inertia of the hot high pressure gas there now exists, "a Partial Vacuum" in the firearm barrel bore 75 and in the muzzle brake 25 and in the vent ports 4. After this, a reverse flow of Atmospheric gas is pulled into the firearm barrel bore 75, at a high rate of speed approaching mach 2.5 passing through vent ports 4 at said 105 degree angle 10 and acting on said Minor truncated socket forms 6 and through the vent ports 4 at said 105 degree angle 10 and acting on said Major truncated socket forms 5 and through the orifice 7 to a lesser extent. The many vent ports 4 at said 105 degree angle 10 offer substantially less resistance, to the Atmospheric gas flow into the muzzle brake 25 with said gas capture chamber 3 and firearm barrel bore 75, than does the caliber specific orifice. At this time the Atmospheric gas being pulled into the muzzle brake 25 and the firearm barrel bore 75 through the vent ports 4, said Minor truncated socket forms 6, said Major truncated socket forms 5, and orifice 7, passing through the gas capture chamber 3 acts to impart energy in a forward direction to the truncated socket forms 5 and to the muzzle brake and firearm thus being the Third Event that further reducing the recoil.

Citing FIG. 8, A THROUGH FIG. 8, E in a firearm not equipped with said muzzle brake one must realize that instability is induced in projectile 100, by the movement of the firearm barrel 70 which occurs during recoil and adds to inaccuracy in the flight path 131 of projectile 100 as it leaves the bore 75 at the muzzle end of the firearm.

Citing FIG. 9, A THROUGH FIG. 9, D a firearm barrel equipped with said muzzle brake 1 of the present invention is stabilized, to the extent that the induced wobble of the centerline 141 of said projectile 100 is very significantly reduced and accuracy is improved.

Citing FIG. 5, On consideration of findings, is the belief that, the projectile 100, flight path 131 is stabilized on exiting the muzzle brake 25 orifice 7, and is influenced by orifice 7, and the 60 degree included angle chamfer 9. This small distance of projectile flight path 131 through orifice 7 and 60 degree chamfer 9 has the effect of realigning and damping the minute wobble of the projectile axis 141 of projectile 100 upon leaving the muzzle brake orifice 7, 60 degree included angle chamfer 9.

Citing FIG. 8 A THROUGH FIG. 8 E Depicting a firearm barrel 70, without a muzzle brake attached.

FIG. 8 A Depicting initiation of firing before any movement has begun, the centerline 141, of projectile 100, is aligned with the centerline 121 of the firearm bore 75, and with the intended flight path 131 of projectile 100.

FIG. 8 B As projectile 100 begins to emerge from firearm barrel 70, exhibiting the effect of recoil and barrel rise, projectile 100, centerline 141, is still aligned with the centerline 121 of the bore 75, and the flight path 131, of projectile 100.

FIG. 8 C As projectile 100 exits the firearm barrel 70, exhibiting the effect of recoil, the base of the projectile 100 will be forced up and out of alignment with the centerline 121 of the bore 75 of the firearm, and deflected from the intended flight path 131, of the projectile 100, so that the centerline of the projectile 141, is no longer aligned with the flight path 131, introducing instability in the projectile 100 and inaccuracy in the flight path 131.

FIG. 8 D Firearm barrel 70, now exhibits the continuing effects of recoil, whereas the hot high pressure gas is being expelled form the bore 75, of the firearm, whereby the ensuing turbulence exerts asymmetrical force to the base of projectile 100 causing further disruption to the stability of the projectile 100 and causing the centerline of the projectile 141 to be pushed further out of alignment with the intended flight path 131 and greater inaccuracy.

FIG. 8 E As projectile 100, moves further from the firearm barrel 70, the gyroscopic effect of the spin imparted to the projectile 100, by rifling in the firearm bore 75 will begin to stabilize the projectile after going through several oscillations.

Citing FIG. 9 A THROUGH FIG. 9 D With the current muzzle brake 1 attached to the firearm barrel 70, very little movement due to recoil is imparted to the firearm barrel 70, and thus the base of projectile 100 is not pushed off the centerline of the flight path 131 to nearly as great an extent thereby not disrupting the intended flight path 131 of the projectile 100 and improving the accuracy of the system.

All of the combined actions described and hereafter named, The First Event, The Second Event, and The Third Event, utilizes a percentage of the captured kinetic energy from each event to reduce recoil and muzzle rise, that would be lost by direct venting in prior art inventions as they do not utilize the novel and substantial high pressure gas controlling functions of the caliber specific orifice 7 end plate 2 with Major truncated socket forms 5 and the Minor truncated socket forms 6 of the current invention. In the Science of Internal Ballistics one must with due diligence, and research, identify all the various components, actions, events, and forces in play propelling a projectile 100 out of the barrel 70 of a firearm and those forces that can be used to reduce or eliminate recoil, muzzle rise and movement.

In a society of gentlemen inventors it will be understood that embodiments of the present invention include, but are not limited, to the scope of the muzzle brake 1 embodiment herein described, designed, constructed, and illustrated in the drawings. Further variations and improved modifications of the above described muzzle brake 1 invention are to be contemplated, and applied without departing from the advanced technological aspects of the present invention.

What is claimed is:

1. A muzzle brake for controlling recoil in a firearm, the muzzle brake comprising:

a body member defining a substantially cylindrical inner cavity having a central axis, the body member comprising:

a rear portion defining a rearward surface of the substantially cylindrical inner cavity, the rear portion defining an internally-threaded first cylindrical through opening extending along the central axis of the substantially cylindrical inner cavity;

a front wall defining a forward surface of the substantially cylindrical inner cavity and a second through opening extending through the front wall along the central axis of the substantially cylindrical inner cavity; and a side wall defining a curved side surface of the substantially cylindrical inner cavity;

the inner cavity being configured to be cylindrical having a smooth bore inner surface that has a uniform diameter between the rearward surface and front wall, and the inner cavity extending outwardly from the central axis to have a greater circumference than the second through opening; and a first plurality of bores extending into an external surface of the side wall and at least partially through the curved side surface of the substantially cylindrical inner cavity, each of the first plurality of bores comprising an outer portion having a substantially cylindrical shape and forming an external vent port of the body member and an inner portion having a hemispherical shape, each inner portion of each of the first plurality of bores at least partially intersecting the substantially cylindrical inner cavity to form a truncated nozzle portion having a leading edge extending along the curved side surface of the substantially cylindrical inner cavity;

whereby when fluid is forced forward through the first cylindrical through opening and into the substantially cylindrical inner cavity, the leading edge of each of the first plurality of bores diverts fluid against the hemispherical inner portion of the bore and outward of the body member through the vent port of the bore, thereby urging the body member forward.

2. The muzzle brake of claim 1, wherein the body member is integrally formed as a single piece construction.

3. The muzzle brake of claim 2 further comprising:

a second plurality of bores extending into the external surface of the side wall, at least partially through the curved side surface of the substantially cylindrical inner cavity and into the front wall, each of the second plurality of bores comprising an outer portion having a substantially cylindrical shape and forming an external vent port of the body member and an inner portion having a hemispherical shape, each inner portion of each of the second plurality of bores at least partially intersecting the forward surface of the substantially cylindrical inner cavity to form a truncated nozzle portion having a leading edge extending along a rearward edge of the second through opening;

whereby when fluid is forced forward through the first cylindrical through opening and into the substantially cylindrical inner cavity, the leading edge of each of the second plurality of bores diverts fluid against the hemispherical inner portion of the bore and outward of the body member through the vent port of the bore, thereby urging the body member forward.

4. The muzzle brake of claim 3, wherein the outer portion of each of the bores of the first and second plurality of bores defines a central axis extending radially outwardly from the central axis of the substantially cylindrical inner cavity.

5. The muzzle brake of claim 4, each central axis of each outer portion of each of the bores of the first and second plurality of bores extending outwardly and rearwardly at an angle between 90 degrees and 135 degrees to the central axis of the substantially cylindrical inner cavity.

6. The muzzle brake of claim 5, each central axis of each outer portion of each of the bores of the first and second plurality of bores extending outwardly and rearwardly at an angle of 105 degrees to the central axis of the substantially cylindrical inner cavity.

7. The muzzle brake of claim 6, wherein the first plurality of bores is disposed in an evenly spaced, radially skewed array about the curved side surface of the substantially cylindrical inner cavity, the array defining a plurality of incremental rows along the central axis of the substantially cylindrical inner cavity.

8. The muzzle brake of claim 7, wherein the second plurality of bores is disposed in an evenly spaced, radially skewed array about the second through opening.

9. The muzzle brake of claim 8, wherein the second through opening is sized to correspond to a bore of a firearm muzzle.

10. The muzzle brake of claim 9, the second through opening having a forward portion defining an outwardly flared chamfer.

11. The muzzle brake of claim 10, the chamfer of the forward portion of the second through opening defining a 60 degree angle with a front surface of the front wall.

12. The muzzle brake of claim 11, wherein the first through opening is sized to correspond to external threads of the firearm muzzle, whereby when the first through opening is threadably received onto the external threads of the firearm muzzle, the central axis of the substantially cylindrical inner cavity is aligned with a center line of the bore of the firearm muzzle.

13. The muzzle brake of claim 12, the body member defining a rear annular surface extending outwardly from the first through opening and configured to abut a portion of the firearm muzzle when the first through opening is threadably received onto the external threads of the firearm muzzle.

* * * * *